US011774086B2

(12) United States Patent
Jiang

(10) Patent No.: US 11,774,086 B2
(45) Date of Patent: Oct. 3, 2023

(54) SIMPLE LIGHT-BLOCKING AND AIR-EXHAUSTING DEVICE, AND STAGE LIGHT FIXTURE INCLUDING SAME

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 185 days.

(21) Appl. No.: 17/364,251

(22) Filed: Jun. 30, 2021

(65) Prior Publication Data

US 2022/0228737 A1 Jul. 21, 2022

Related U.S. Application Data

(63) Continuation of application No. PCT/CN2020/072469, filed on Jan. 16, 2020.

(30) Foreign Application Priority Data

May 31, 2019 (CN) ..... 201910471864.4

(51) Int. Cl.
*F21V 29/83* (2015.01)
*F21V 1/00* (2006.01)
*F21W 131/406* (2006.01)

(52) U.S. Cl.
CPC ..... *F21V 29/83* (2015.01); *F21V 1/00* (2013.01); *F21W 2131/406* (2013.01)

(58) Field of Classification Search
CPC ..... F21V 29/83; F21V 29/50; F21V 29/502; F21V 29/503; F21V 29/507; G03B 21/20–208; F21W 2131/406; F21W 2131/407; F21W 2131/105
See application file for complete search history.

(56) References Cited

U.S. PATENT DOCUMENTS

| | | | | |
|---|---|---|---|---|
| 4,630,182 | A | 12/1986 | Moroi | |
| 7,484,863 | B1 * | 2/2009 | Aubrey | F21V 19/0065 362/373 |
| 8,534,877 | B1 * | 9/2013 | Leadford | F21V 7/0091 362/310 |

FOREIGN PATENT DOCUMENTS

| | | | |
|---|---|---|---|
| CN | 2650180 | Y | 10/2004 |
| CN | 1948826 | A | 4/2007 |
| CN | 201992559 | U | 9/2011 |
| CN | 205079179 | U | 3/2016 |

* cited by examiner

*Primary Examiner* — Mariceli Santiago
(74) *Attorney, Agent, or Firm* — MUNCY, GEISSLER, OLDS & LOWE, P.C.

(57) ABSTRACT

A simple light-blocking and air-exhausting device includes a ventilation plate and a light-blocking plate arranged oppositely and spaced apart from each other. The ventilation plate is provided with an air vent formed by die-cutting the ventilation plate, and vertical projection of the light-blocking plate on the ventilation plate overlaps the air vent. The vertical projection of the light-blocking plate on the ventilation plate overlaps the air vents on the ventilation plate, so that the light-blocking plate can prevent light from leaking out of the air vents, while air flow can flow out from a gap between the light-blocking plate and the ventilation plate.

20 Claims, 3 Drawing Sheets

SIMPLE LIGHT-BLOCKING AND AIR-EXHAUSTING DEVICE, AND STAGE LIGHT FIXTURE INCLUDING SAME

CROSS REFERENCE TO RELATED APPLICATIONS

The present application is a continuation of International Application No. PCT/CN2020/072469, filed on Jan. 16, 2020, which claims priority from Chinese Patent Application No. 201910471864.4 filed on May 31, 2019, all of which are hereby incorporated herein by reference.

TECHNICAL FIELD

The present invention relates to the field of heat dissipation techniques of light fixtures, in particular to a simple light-blocking and air-exhausting device and a stage light fixture including the same.

BACKGROUND

To ensure a normal service life of a light source of a stage light fixture, it is required to maintain a relatively stable environment. Therefore, the light source is usually placed in a relatively closed small environment. An outside of the light source is provided with a fan device for blowing cold air outside a light source chamber into a closed space of the light source chamber. An air outlet is provided in the closed space of the light source chamber, so that hot air flow in the light source chamber flows outside of the light fixture body through the air outlet. Since strong light exists within the light source chamber, it is required to provide a light-blocking structure at the air outlet so as to prevent light leakage from affecting the light fixture effect. The configuration of the light-blocking structure can facilitate air exhaust, be effective in light blocking, and be easily removed for replacement of the light source. In order to meet the requirements, in related art a window-shade radiator is configured at the air outlet. However, a structure and a manufacturing process of such radiator are generally complicated, and both frame and blades of the window-shade radiator need to be separately produced and assembled, thus resulting in higher cost.

SUMMARY

The present invention thus provides a simple light-blocking and air-exhausting device, which is simple in structure and manufacturing process, low in cost, and has a better light-blocking and ventilation effect at the same time.

According to the present invention, the simple light-blocking and air-exhausting device includes a ventilation plate and a light-blocking plate arranged oppositely and spaced apart from each other. The ventilation plate is provided with an air vent formed by die-cutting of the ventilation plate. Vertical projection of the light-blocking plate on the ventilation plate overlaps the air vents.

In the present invention, the vertical projection of the light-blocking plate on the ventilation plate is configured to overlap the air vent on the ventilation plate, so that the light-blocking plate can prevent light from leaking out of the air vent, while air flow can flow out from a gap between the light-blocking plate and the ventilation plate. The light-blocking plate and the ventilation plate are common flat plates without any special design, which can be directly formed by die-cutting. The air vent provided on the ventilation plate are also formed by die-cutting, so that the air vent can be processed simultaneously when the ventilation plate is manufactured, which results in easy manufacturing of the entire simple light-blocking and air-exhausting device compared to manufacturing a window-shade radiator, achieving a better light-blocking and ventilation effect with only two common flat plates fixed to each other, and effective assembly time reduction and lower production costs.

A side plate that surrounds the light-blocking plate is further provided at one side of the ventilation plate close to the light-blocking plate. The configuration of the side plate can prevent the hot air flow from flowing out of a gap between the ventilation plate and a sealed chamber, so that even when the ventilation plate or the sealed chamber has protrusion or unevenness during manufacture, or when the both cannot fit closely due to vibration in use, or when the ventilation plate moves up or down, the side plate can act as an air guiding channel so as to smoothly direct the hot air flow out of a housing.

A height of the side plate is smaller than a minimum distance between the ventilation plate and the light-blocking plate. This facilitates the hot air flow to enter between the light-blocking plate and the ventilation plate.

The side plate has an annular shape with larger size than the light-blocking plate. This facilitates the hot air flow between the light-blocking plate and the ventilation plate, so that the hot air flow can be directed out of the housing.

The ventilation plate can include an air-permeable plate and a substrate attached to each other. The air-permeable plate is provided with a first air vent. The substrate is provided with a second air vent corresponding to the first air vent. The substrate is located at one side of the air-permeable plate close to the light-blocking plate. The side plate is located on the substrate. The air-permeable plate is generally thick, and the side plate has no requirement for thickness, thus if the side plate is provided directly on the air-permeable plate, the both need to be welded and assembled together after separate production, or the side plate needs to be machined on the air-permeable plate, which leads to a cumbersome and costly process. The additional substrate is provided to arrange the side plate on the substrate, so that the whole can be formed directly after punching and folding by using plates, which is convenient and efficient.

The ventilation plate is provided with a pull rod outside a projection area of the light-blocking plate, the pull rod has a length larger than a maximum distance between the light-blocking plate and the ventilation plate. An end of the pull rod is provided with a block. The pull rod can prevent the device from falling after being disassembled, and plays a certain role in safety protection. By pulling and rotating the pull rod, the air outlet can be opened or closed.

The pull rod and the light-blocking plate are preferably on the same side of the ventilation plate, so that the entire simple light-blocking and air-exhausting device occupies a smaller space, and the installation is more convenient.

Alternatively, the ventilation plate includes an air-permeable plate and a fixing plate attached to each other. The air-permeable plate is provided with a first air vent. The fixing plate is provided with a third air vent corresponding to the first air vent. The fixing plate is located at one side of the air-permeable plate close to the light-blocking plate, and the pull rod is in a fixed connection with the fixing plate. Screw holes are provided in the air-permeable plate to secure the air-permeable plate, so that the fixing plate is separately provided to secure the pull rod, which can thus prevent that a set screw of the pull rod is removed by mistake when the air-permeable plate is disassembled, avoiding falling of the ventilation plate.

The first air vent includes a plurality of strip-shaped holes arranged in parallel, which avoids that debris or rain enters the first air vent due to too large hole.

Further, several support bases are provided between the light-blocking plate and the ventilation plate. A screw penetrates the light-blocking plate and each support base to connect with the ventilation plate. The support base can ensure a distance between the light-blocking plate and the ventilation plate.

The present invention also provides a stage light fixture including a light source chamber and the simple light-blocking and air-exhausting device described above. The light source chamber has an air outlet, the ventilation plate covers the air outlet, and the light-blocking plate is located within the light source chamber.

The light-blocking plate is located within the light source chamber. The light-blocking plate is initially used for light blocking, and then the ventilation plate covering the air outlet is used for ventilation. Such configuration can better prevent light from leaking out without affecting ventilation.

The side plate that surrounds the light-blocking plate is provided at one side of the ventilation plate close to the light-blocking plate, and an outer side wall of the side plate fits an annular side wall of the air outlet formed by the light source chamber. The side plate can prevent the hot air flow from flowing out of a gap between the ventilation plate and the light source chamber and entering an inside of the housing of the stage light fixture, which avoids a rising ambient temperature inside the housing of the stage light fixture. In addition, the outer side wall of the side plate fits the annular side wall of the air outlet formed by the light source chamber, so that when the simple light-blocking and air-exhausting device is installed, even when the ventilation plate or the light source chamber has protrusion or unevenness during manufacture, or when the both cannot fit closely due to vibration in use, or when the ventilation plate moves up or down, the side plate can act as an air guiding channel so as to smoothly direct the hot air flow out of the light source chamber and the housing of the stage light fixture without leakage.

DETAILED DESCRIPTION

Figure 1:
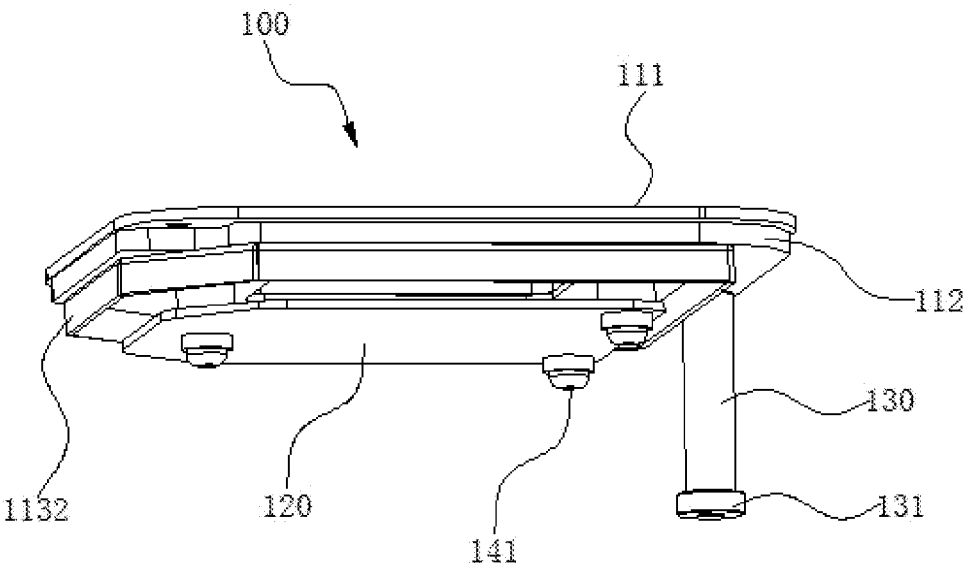
FIG. 1 is an overall schematic structural view of a simple light-blocking and air-exhausting device according to the present invention.
Figure 2:
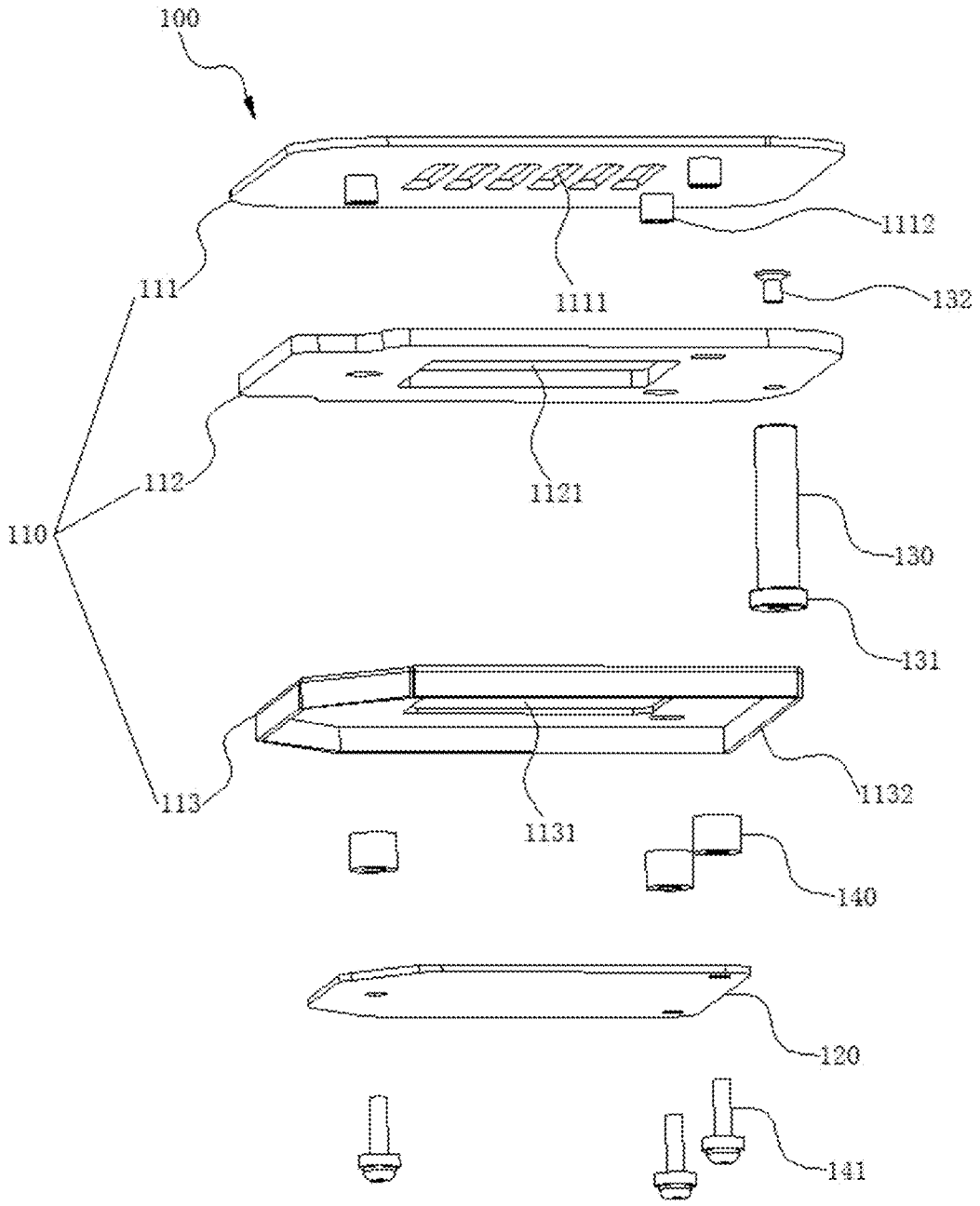
FIG. 2 is an exploded structural schematic view of the simple light-blocking and air-exhausting device according to the present invention.
Figure 3:
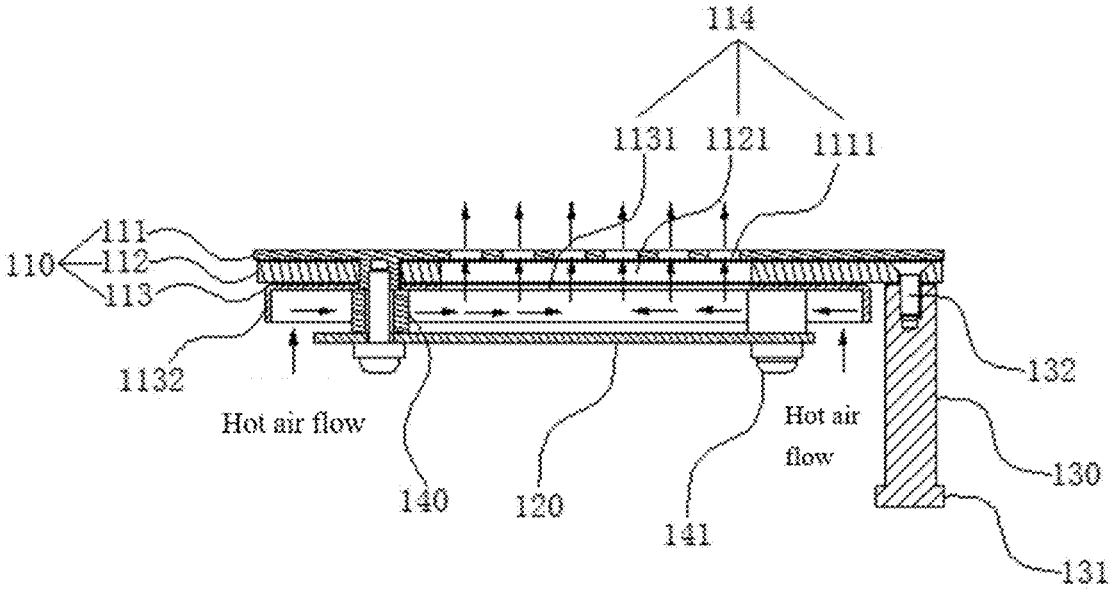
FIG. 3 is a schematic cross-sectional structural view of the simple light-blocking and air-exhausting device according to the present invention.

FIGS. 1 to 3 show a simple light-blocking and air-exhausting device 100 according to some embodiments. The device 100 includes a ventilation plate 110 and a light-blocking plate 120 which are arranged oppositely and spaced apart from each other. The ventilation plate 110 is provided with an air vent 114 formed by die-cutting of the ventilation plate 110. Vertical projection of the light-blocking plate 120 on the ventilation plate 110 overlaps the air vents 114.

The vertical projection of the light-blocking plate 120 on the ventilation plate 110 is configured to overlap the air vent 114 on the ventilation plate 110, so that the light-blocking plate 120 can prevent light from leaking out of the air vents 114, while air flow can flow out from a gap between the light-blocking plate 120 and the ventilation plate 110. The light-blocking plate 120 and the ventilation plate 110 are common flat plates without any special design, which can be directly formed by die-cutting. The air vent 114 provided on the ventilation plate 110 are also formed by die-cutting, so that the air vent 114 can be processed simultaneously when the ventilation plate 110 is manufactured, which results in easy manufacturing of the entire device 100 compared to manufacturing a window-shade radiator, achieving a better light-blocking and ventilation effect with only two common flat plates fixed to each other, and effective assembly time reduction and lower production costs.

Figure 4:
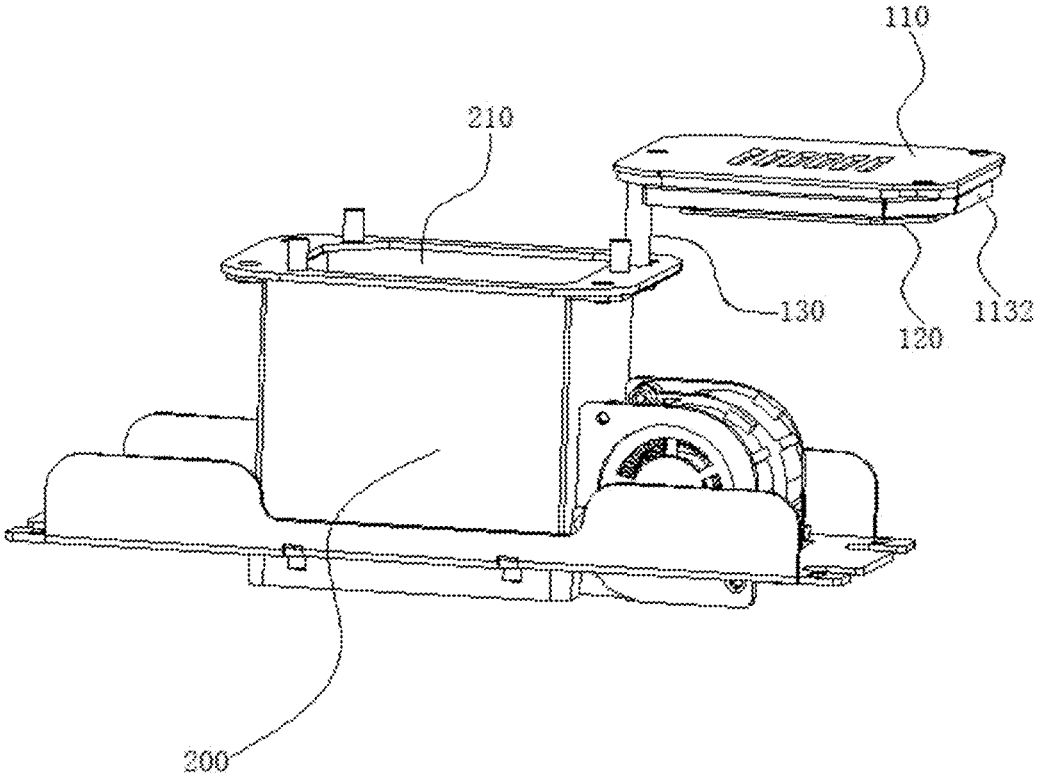
FIG. 4 is a schematic view of a mating structure of the simple light-blocking and air-exhausting device and a light source chamber according to the present invention.

The device 100 according to these embodiments is generally applied to a light source chamber 200 of a stage light fixture shown in FIG. 4. An air outlet 210 is provided on the light source chamber 200, and the device 100 covers the air outlet 210 to achieve a light-blocking ventilation effect.

According to at least one embodiment, a side plate 1132 that surrounds the light-blocking plate 120 is provided at one side of the ventilation plate 110 close to the light-blocking plate 120. The side plate 1132 can prevent the hot air flow from flowing out of a gap between the ventilation plate 110 and the light source chamber 200, so that even when the ventilation plate 110 or the light source chamber 200 has protrusion or unevenness during manufacture, or when the both cannot fit closely due to vibration in use, or when the ventilation plate 110 moves up or down, the side plate 1132 can act as an air guiding channel so as to smoothly direct the hot air flow out of a housing.

A height of the side plate 1132 is preferably smaller than a minimum distance between the ventilation plate 110 and the light-blocking plate 120. This facilitates the hot air flow to enter between the light-blocking plate 120 and the ventilation plate 110. Preferably, a height range of the side plate 1132 is between 15 mm and 25 mm, and the minimum distance between the substrate 113 and the light-blocking plate 120 ranges between 25 mm and 35 mm.

A size of an annular shape formed by the side plate 1132 is larger than the light-blocking plate 120. This facilitates the hot air flow between the light-blocking plate 120 and the ventilation plate 110, so that the hot air flow can be directed out of the housing. Preferably, the annular shape formed by the side plate 1132 is similar to a shape of the light-blocking plate 120, but with different size.

According to at least one embodiment, the ventilation plate 110 includes an air-permeable plate 111 and a substrate 113 attached to each other. The air-permeable plate 111 is provided with a first air vent 1111. The substrate 113 is provided with a second air vent 1131 corresponding to the first air vent 1111. The substrate 113 is located at one side of the air-permeable plate 111 close to the light-blocking plate 120. The side plate 1132 is located on the substrate 113. The air-permeable plate 111 is generally thick, and the side plate 1132 has no requirement for thickness. If the side plate 1132 is provided directly on the air-permeable plate 111, the both need to be welded and assembled together after separate production, or the side plate 1132 needs to be machined on the air-permeable plate 111, which leads to a cumbersome and costly process. The additional substrate 113 is provided to arrange the side plate 1132 thereon, so that the whole can be formed directly after punching and folding by using plates, which is convenient and efficient.

Preferably, the air-permeable plate 111 and the substrate 113 are made of metal material.

According to at least one embodiment, the ventilation plate 110 is provided with a pull rod 130 outside a projection area of the light-blocking plate 120 on the ventilation plate 110. The pull rod 130 has a length larger than a maximum distance between the light-blocking plate 120 and the ventilation plate 110. An end of the pull rod 130 is provided with a block 131. The pull rod 130 can prevent the device 100 from falling after being disassembled, and play a certain role in safety protection. By pulling and rotating the pull rod 130, the air outlet 210 of the light source chamber 200 can be opened or closed to quickly replace the light source.

Preferably, the pull rod 130 and the light-blocking plate 120 are on the same side of the ventilation plate 110. Such configuration makes the entire simple light-blocking and air-exhausting device 100 occupy a smaller space, and more convenient in installation.

According to some embodiments, the ventilation plate 110 includes an air-permeable plate 111 and a fixing plate 112 attached to each other. The fixing plate 112 is located at one side of the air-permeable plate 111 close to the light-blocking plate 120. The air-permeable plate 111 is provided with a first air vent 1111. The fixing plate 112 is provided with a third air vent 1121 corresponding to the first air vent 1111. The pull rod 130 is in a fixed connection with the fixing plate 112. Screw holes are provided in the air-permeable plate 111 to secure the air-permeable plate 111, and the fixing plate 112 is separately provided to secure the pull rod 130, it can thus avoid that a set screw 132 of the pull rod 130 is removed by mistake when the air-permeable plate 111 is disassembled, which causes the ventilation plate 110 to fall.

The air-permeable plate 111 and the fixing plate 112 are preferably made of metal material.

Optionally, the ventilation plate 110 can includes the air-permeable plate 111, the fixing plate 112 and the substrate 113 that are sequentially attached toward to the light-blocking plate 120. The air-permeable plate 111 is provided with the first air vent 1111. The substrate 113 and the fixing plate 112 are provided with the second air vent 1131 and the third air vent 1121 respectively corresponding to the first air vent 1111. The pull rod 130 is in a fixed connection with the fixing plate 112. The side plate 1132 that surrounds the light-blocking plate 120 is provided at one side of the substrate 113 close to the light-blocking plate 120. The screw holes are provided in the air-permeable plate 111 to secure the air-permeable plate 111 to the light source chamber 200, and the fixing plate 112 is separately provided to secure the pull rod 130, and thus it can avoid that the set screw 132 of the pull rod 130 is removed by mistake when the air-permeable plate 111 is disassembled from the light source chamber 200, which causes the ventilation plate 110 to fall. The air-permeable plate 111, the fixing plate 112, and the substrate 113 are preferably made of metal material.

According to one embodiment, the air-permeable plate 111 covers a connection position of the fixing plate 112 and the pull rod 130. The connection position of the fixing plate 112 and the pull rod 130 is hidden to better avoid the removal by mistake.

The first air vent 1111 includes a plurality of strip-shaped holes arranged in parallel, which avoids that debris or rain enters the first air vent 1111 due to too large hole.

When the ventilation plate 110 includes the air-permeable plate 111 and the fixing plate 112 attached to each other, the third air vent 1121 is a large continuous opening.

When the ventilation plate 110 includes the air-permeable plate 111, the fixing plate 112, and the substrate 113 that are sequentially attached, one of the first air vent 1111 and the second air vent 1131 includes a plurality of strip-shaped holes arranged in parallel, and the third air vent 1121 is a large continuous opening.

Some support bases 140 are provided between the light-blocking plate 120 and the ventilation plate 110. A screw 141 penetrates the light-blocking plate 120 and each support base 140 to connect with the ventilation plate 110. The support bases 140 can ensure a distance between the light-blocking plate 120 and the ventilation plate 110. A nut of the screw 141 is located inside the light source chamber 200, so that the appearance is more aesthetically pleasing and the ventilation plate 110 can be easily to be arranged in a multi-layered manner.

Connecting columns 1112 used to connect with the screw 141 are provided on the ventilation plate 110. When the ventilation plate 110 includes the air-permeable plate 111, the fixing plate 112, and the substrate 113 that are sequentially attached, the connecting columns 1112 are located on the air-permeable plate 111, and through holes corresponding to the connecting columns 1112 are provided on the fixing plate 112 and the substrate 113.

FIG. 4 is shown a stage light fixture including a light source chamber 200 and the simple light-blocking and air-exhausting device described above. The light source chamber 200 has an air outlet 210. The ventilation plate 110 covers the air outlet 210, and the light-blocking plate 120 is located within the light source chamber 200.

The light-blocking plate 120 is located within the light source chamber 200. The light-blocking plate 120 is initially used for light blocking, and then the ventilation plate 110 covering the air outlet 210 is used for ventilation. Such configuration can better prevent light from leaking out without affecting ventilation.

In this embodiment, the side plate 1132 that surrounds the light-blocking plate 120 is provided at one side of the ventilation plate 110 closer to the light-blocking plate 120, and an outer side wall of the side plate 1132 fits an annular side wall of the air outlet 210 formed by the light source chamber 200. The side plate 1132 can prevent the hot air from flowing out of the gap between the ventilation plate 110 and the light source chamber 200 to enter an inside of the housing of the stage light fixture, which avoids a rising ambient temperature inside the housing of the stage light fixture. In addition, the outer side wall of the side plate 1132 fits the annular side wall of the air outlet 210 formed by the light source chamber 200, so that even when the ventilation plate 110 or the light source chamber 200 has protrusion or unevenness during manufacture, or when the both cannot fit closely due to vibration in use, or when the ventilation plate 110 moves up or down, the side plate 1132 can act as an air guiding channel so as to smoothly direct the hot air flow out of the light source chamber 200 and the housing of the stage light fixture.

The invention claimed is:

1. A simple light-blocking and air-exhausting device, comprising:

a ventilation plate and a light-blocking plate arranged oppositely and spaced apart from each other, wherein the ventilation plate is provided with an air vent formed by die-cutting of the ventilation plate, and vertical projection of the light-blocking plate on the ventilation plate overlaps the air vent, a side plate that surrounds the light-blocking plate is provided at one side of the ventilation plate close to the light-blocking plate, and the ventilation plate comprises an air-permeable plate and a substrate attached to each other, the air-permeable plate is provided with a first air vent, the substrate is provided with a second air vent corresponding to the first air vent, the substrate is located at one side of the air-permeable plate close to the light-blocking plate, and the side plate is located on the substrate.

2. The device according to claim 1, wherein a height of the side plate is smaller than a minimum distance between the ventilation plate and the light-blocking plate.

3. The device according to claim 2, wherein the height of the side plate is between 15 mm to 25 mm.

4. The device according to claim 3, wherein the minimum distance between the ventilation plate and the light-blocking plate is between 25 mm to 35 mm.

5. The device according to claim 1, wherein the side plate defines an annular shape with larger size than the light-blocking plate.

6. The device according to claim 1, wherein the first air vent includes a plurality of strip-shaped holes arranged in parallel.

7. The device according to claim 1, wherein the ventilation plate is provided with a pull rod outside a projection area of the light-blocking plate, the pull rod has a length larger than a maximum distance between the light-blocking plate and the ventilation plate, and an end of the pull rod is provided with a block.

8. The device according to claim 7, wherein the pull rod and the light-blocking plate are on same side of the ventilation plate.

9. The device according to claim 7, wherein the ventilation plate further includes a fixing plate, the air-permeable plate, the fixing plate, and the substrate are sequentially attached toward the light-blocking plate, the pull rod is in a fixed connection with the fixing plat, and the side plate that surrounds the light-blocking plate is provided at one side of the substrate close to the light-blocking plate, and the fixing plate is provided with a third air vent corresponding to the first air vent.

10. The device according to claim 1, wherein a plurality of support bases are provided between the light-blocking plate and the ventilation plate, a screw penetrates the light-blocking plate and each of the plurality of support bases to connect with the ventilation plate.

11. A stage light fixture, comprising a light source chamber and the simple light-blocking and air-exhausting device according to claim 1, wherein the light source chamber has an air outlet, the ventilation plate covers the air outlet, and the light-blocking plate is located within the light source chamber.

12. The stage light fixture according to claim 11, wherein a side plate that surrounds the light-blocking plate is provided at one side of the ventilation plate close to the light-blocking plate, and an outer side wall of the side plate fits an annular side wall of the air outlet formed by the light source chamber.

13. A light-blocking and air-exhausting device, comprising: a ventilation plate and a light-blocking plate arranged oppositely and spaced apart from each other, wherein the ventilation plate is provided with an air vent formed by die-cutting of the ventilation plate, and vertical projection of the light-blocking plate on the ventilation plate overlaps the air vent, the ventilation plate is provided with a pull rod outside a projection area of the light-blocking plate, the pull rod has a length larger than a maximum distance between the light-blocking plate and the ventilation plate, and an end of the pull rod is provided with a block, the ventilation plate includes an air-permeable plate and a fixing plate attached to each other, the fixing plate is located at one side of the air-permeable plate close to the light-blocking plate, and the pull rod is in a fixed connection with the fixing plate, and the air-permeable plate is provided with a first air vent, the fixing plate is provided with an additional air vent corresponding to the first air vent.

14. The device according to claim 13, wherein the first air vent includes a plurality of strip-shaped holes arranged in parallel.

15. The device according to claim 14, wherein a height of the side plate is smaller than a minimum distance between the ventilation plate and the light-blocking plate.

16. The device according to claim 15, wherein the height of the side plate is between 15 mm to 25 mm.

17. The device according to claim 16, wherein the minimum distance between the ventilation plate and the light-blocking plate is between 25 mm to 35 mm.

18. The device according to claim 13, wherein the pull rod and the light-blocking plate are on same side of the ventilation plate.

19. The device according to claim 13, wherein a side plate that surrounds the light-blocking plate is provided at one side of the ventilation plate close to the light-blocking plate.

20. The device according to claim 19, wherein the side plate defines an annular shape with larger size than the light-blocking plate.

* * * * *